United States Patent [19]

Ziehmer

[11] Patent Number: 4,984,407

[45] Date of Patent: Jan. 15, 1991

[54] FRAMEWORK

[75] Inventor: Kurt Ziehmer, Feldstrasse 64, D-4000 Düsseldorf 30, Fed. Rep. of Germany

[73] Assignee: Kurt Ziehmer, Dusseldorf, Fed. Rep. of Germany

[21] Appl. No.: 500,527

[22] Filed: Mar. 28, 1990

[30] Foreign Application Priority Data

Mar. 28, 1989 [DE] Fed. Rep. of Germany ..... 3910085

[51] Int. Cl.[5] ..... E04H 12/00

[52] U.S. Cl. ..... 52/648; 52/653; 403/172

[58] Field of Search ..... 52/653, 648, 659, DIG. 10, 52/646, 81, 280; 403/171, 172, 176; 312/257 SK

[56] References Cited

U.S. PATENT DOCUMENTS

| | | | |
|---|---|---|---|
| 918,715 | 4/1909 | Wedmore | 52/653 |
| 2,956,806 | 10/1960 | Routson | 52/648 X |
| 3,674,276 | 7/1972 | Street et al. | 52/DIG. 10 |
| 4,065,890 | 1/1978 | Fenner | 403/172 X |
| 4,467,583 | 8/1984 | Hasak | 52/653 |
| 4,637,941 | 1/1987 | Rochte | 52/646 X |
| 4,856,765 | 8/1989 | Kohno et al. | 57/646 X |
| 4,905,443 | 3/1990 | Sutcliffe et al. | 52/648 |

*Primary Examiner*—Henry E. Raduazo
*Assistant Examiner*—Creighton Smith
*Attorney, Agent, or Firm*—Poms, Smith, Lande & Rose

[57] ABSTRACT

A framework has bearing members, each of which consists substantially of a wire spiral, which is stayed by means of a plurality of stiffening wires, which extend in the longitudinal or pitch direction of the spiral and are arranged around its circumference and which are securely fastened to it at mutual contact points. At each end, the bearing members are closed by an end ring. Joint elements serve to connect the ends of two or more bearing members to one another. The joint elements have the shape of a regular polyhedron and consist of several wire rings which are arranged on the delimiting surfaces of the polyhedron, which contact each other pair-wise on the edges of the polyhedron, and which are securely joined with each other at mutual contact points. A tensioning ring is provided for connecting the joint elements with the ends of the bearing members, one end of the tensioning ring being insertable into the wire rings of the joint element, and the other end of the tensioning ring being insertable into the end rings of the bearing members.

13 Claims, 1 Drawing Sheet

FIG. 1
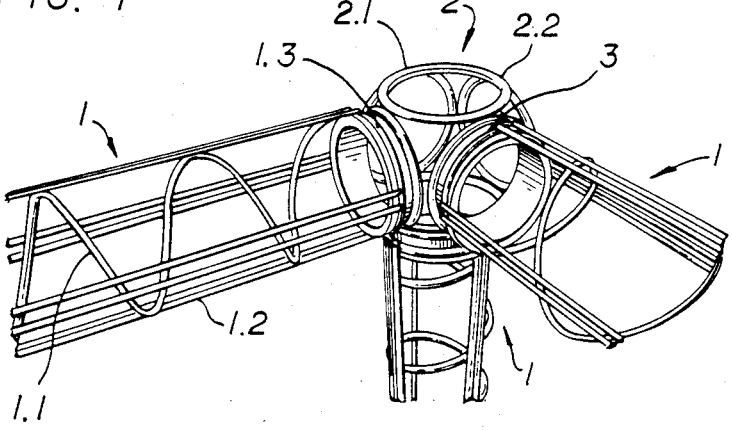
FIG. 3
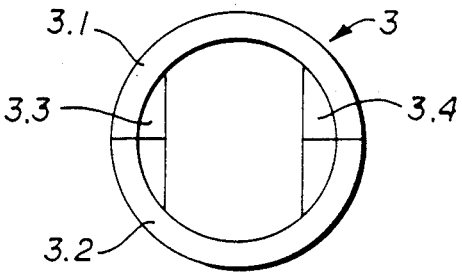
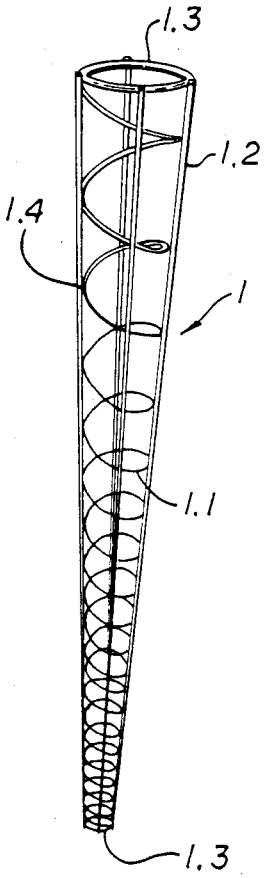
FIG. 2
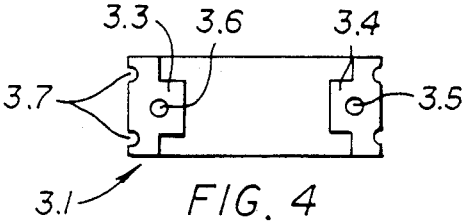
FIG. 4
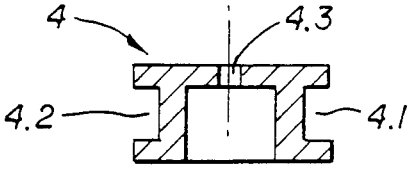
FIG. 5

FRAMEWORK

BACKGROUND OF THE INVENTION

The present invention relates to a framework having bearing members, each of which comprises a wire spiral stiffened by a plurality of stiffening wires.

Bearing members of this type are known, for example from the Swiss patent text, No. 560,350. Similar bearing members are also described in the German text ("AuslegelC schrift"), which was laid open to the public as No. 2,236,086. Connectors for the bearing members are also set forth in these texts. These connectors are relatively difficult to handle and give the construction as a whole an appearance which is not particularly pleasing from an aesthetic viewpoint.

SUMMARY OF THE INVENTION

The primary object of the invention is to provide a means for connecting the bearing members, which makes possible a versatile and variable framework construction while still being easy to handle, and which gives the framework as a whole an aesthetically satisfying appearance.

This invention accomplishes this object by including in the framework:

(1) the plurality of stiffening wires which extend in a longitudinal direction of the wire spiral, which are arranged about the circumference of the wire spiral, and which are securely fastened to the wire spiral at mutual first contact points, for stiffening and staying the wire spiral;

(2) end rings for closing each end of each bearing member;

(3) joint elements for connecting the ends of at least two of the bearing members, each joint element having substantially the shape of a regular polyhedron and comprising a plurality of wire rings, and with the wire rings being provided on delimiting surfaces of the polyhedron and contacting each other pairwise on edges of the polyhedron and being mutually and securely joined together at second contact points; and (4) tensioning rings for connecting each joint element with the ends of the bearing members, with a first end of each tensioning ring being insertable into the wire rings of the joint element and a second end of each tensioning ring being insertable into the end rings of the bearing members.

Advantageous and preferred embodiments of the framework according to the invention are characterized according to the dependent claims.

The same wire is preferably used for the end ring as is used to form the wire spiral itself The diameter of the end ring is further preferably chosen to correspond to the diameter of the wire spiral at its ends.

The wire spiral is preferably stayed and stiffened by four longitudinally extending stiffening wires, or by four pairs of longitudinally extending stiffening wires, which are arranged mutually equidistant about the circumference of the wire spiral. The pitch of the spiral is preferably chosen to be approximately equal to its diameter.

The ratio between the diameter of the wire spiral and the diameter of the wire which forms the spiral is preferably approximately 23:1; the ratio between the diameter of the wire spiral and the diameter of the stiffening wires is preferably approximately 30:1; and the diameter of the spiral is preferably chosen to be approximately 45 mm.

About their longitudinal axes, the bearing members are preferably rotationally symmetric, with the most preferred shape being cylindrical.

Each of the two ends of the wire spiral preferably coincides with a point of contact of one of the stiffening wires.

The diameter of the wire ring of the joint elements preferably corresponds to the diameter of the end ring of the wire spiral.

In their outer circumferential surfaces, the tensioning rings may advantageously be provided with two parallel, spaced-apart, circumferential grooves for at least partially receiving and securing the wire ring of the joint elements and the end ring of the bearing member, respectively.

Finally, end elements may also be provided which may be inserted into and secured (preferrably by being screwed) in the tensioning rings; these end elements may be used as holding or mounting elements, for example, for screwing the framework onto the floor, onto a wall or a ceiling, or even for mounting electrical connectors.

An exemplifying embodiment of the invention is explained below with reference to the accompanying drawings.

BRIEF DESCRIPTION OF THE DRAWINGS

FIG. 1 is a perspective view of a corner of a framework according to the invention, in which the end portions of three bearing members and a joint element are shown;

FIG. 2 is likewise a perspective view of a bearing member for a framework according to the invention;

FIG. 3 shows a tensioning ring for connecting the bearing and joint elements;

FIG. 4 shows a cross-section of the upper half of the tensioning ring of FIG. 3; and FIG. 5 is a cross-sectional representation of an end element which can be inserted into the tensioning ring of FIGS. 3 and 4.

In the figures, corresponding parts are provided with the same reference numbers.

DETAILED DESCRIPTION OF THE PREFERRED EMBODIMENT

In FIG. 1, three similar bearing members are designated with the reference numeral 1, and the bearing members are connected to one another via a joint element 2, with each pair of bearing members forming a right angle. One single bearing member 1 is shown on its own in FIG. 2. The bearing members consist substantially of a cylindrical wire spiral 1.1, which is stiffened by lengthwise extending stiffening wires 1.2, or by pairs of stiffening wires 1.2 (FIG. 1). At the mutual contact points, such as, for example, at the contact point 1.4 (FIG. 2), the wire spiral and the stiffening wires are securely joined, with the joints preferably being made as welded or spot-welded joints. Each end of the bearing members is closed by means of end rings, which are designated 1.3. Each of the two ends of the wire spiral 1.1 coincides with a contact point of one of the stiffening wires 1.2.

In the chosen example, the joint element 2 is cube-shaped, providing a right-angle connection of several bearing members 1. It consists in total of six rings, of which only one is marked with the reference number 2.1 in FIG. 1. At their mutual points of contact, for example at the point 2.2, the six rings 2.1 are securely fastened to one another, once again preferably by welding. The diameter of the rings corresponds to the diameter of the end rings 1.2 of the bearing members, whereby their diameters conform to that of the wire spiral 1.1.

Tensioning rings serve as connecting elements between the bearing members 1.1 and the joint element 2. In FIG. 1, only one of the tensioning rings is marked with the reference numeral 3. As is seen in FIGS. 3 and 4, the tensioning rings 3 consist of two parts 3.1 and 3.2. On their inner circumference, the tensioning rings have diametrically opposing crosspieces 3.3 and 3.4, in which threaded bores 3.5 and 3.6 are provided for receiving threaded bolts or tensioning screws. On their outer circumference, the tensioning rings are provided with two grooves 3.7 which extend around the tensioning ring for receiving and securing the end rings 1.3 of the bearing members 1.1 and the rings 2.1 of the joint element, respectively.

Finally, FIG. 5 shows yet another end element 4 which is insertable into the tensioning ring 3 of FIGS. 3 and 4. This figure shows the shape and size of the interior space (designated 3.6 in FIG. 3) of the tensioning ring 3, and is to that extent insertable therein. After the end elements are inserted, and when they are screwed into the interior space 3.6, the two crosspieces 3.3 and 3.4 of the tensioning ring extend into corresponding recesses 4.1 and 4.2 on the circumference of the end element, whereby the end element is jammed into the tensioning ring. Additionally, restraining pieces (not shown in the drawings) may be provided in order to secure the end element in the screwed-in position. The reference numeral 4.3 designates yet another bore provided in the end element, for example, in order to receive a screw when the framework according to the invention is to be screwed in somewhere.

I claim:

1. A framework comprising:

(a) bearing members, each of which is made of wire, has two ends, and comprises:

(i) a wire spiral;

(ii) a plurality of stiffening wires which extend in a longitudinal direction of said wire spiral, which are arranged about the circumference of said wire spiral, and which are securely fastened to said wire spiral at mutual first contact points, for stiffening and staying said wire spiral; and (iii) end rings for closing each end of said bearing member;

(b) joint elements for connecting the ends of at least two of said bearing members, each said joint element having substantially the shape of a regular polyhedron and comprising a plurality of wire rings, said wire rings being provided on delimiting surfaces of said polyhedron and contacting each other pairwise on edges of the polyhedron and being mutually and securely joined together at second contact points; and (c) tensioning rings for connecting each said joint element with the ends of the bearing members, a first end of each said tensioning ring being insertable into the wire rings of the joint element and a second end of each said tensioning ring being insertable into the end rings of the bearing members.

2. A framework as defined in claim 1, in which each of said end rings of said bearing members is formed as a portion of the same wire which makes up the wire spiral, and in which the diameter of each of said end rings further corresponds to the end diameter of the wire spiral.

3. A framework as defined in claim 1, in which the stiffening wires of each bearing member are four in number and are arranged mutually equidistant on the circumference of the wire spiral.

4. A framework as defined in claim 1, in which the stiffening wires of each bearing member are arranged as four wire pairs disposed mutually equidistant on the circumference of the wire spiral 5. A framework as defined in claim 1, the pitch of said wire spiral being substantially equal to its diameter.

6. A framework as defined in claim 1, the diameter of the wire spiral being related to the diameter of the wire used to make up the spiral substantially in the proportion 23:1, and to the diameter of the stiffening wires substantially in the proportion 30:1, the diameter of the spiral being substantially 45 mm.

7. A framework as defined in claim 1, said bearing members being rotationally symmetrical about their longitudinal axes.

8. A framework as defined in claim 6, said bearing members being substantially cylindrical.

9. A framework as defined in claim 1, in which each end of the wire spiral coincides at one of said first contact points with one of said stiffening wires.

10. A framework as defined in claim 1, in which the diameter of the wire rings of the joint elements corresponds to the diameter of the end rings of the wire spiral.

11. A framework as defined in claim 1, in which two parallel and spaced-apart circumferential grooves are provided in each of the tensioning rings for at least partially receiving and securing, respectively, the wire rings of the joint elements and the end rings of the bearing members.

12. A framework as defined in claim 1, in which securable end elements are provided for insertion into said tensioning rings.

13. A framework as defined in claim 12, in which said end elements are provided screwing into said tensioning rings.

* * * * *